US008528266B2

(12) United States Patent
Ellen

(10) Patent No.: US 8,528,266 B2
(45) Date of Patent: Sep. 10, 2013

(54) DOMED NON-STEEL ROOF STRUCTURE

(75) Inventor: Murray Ellen, North Ryde (AU)

(73) Assignee: The Square Company Pty Ltd., New South Wales (AU)

( * ) Notice: Subject to any disclaimer, the term of this patent is extended or adjusted under 35 U.S.C. 154(b) by 0 days.

(21) Appl. No.: 13/635,458

(22) PCT Filed: Mar. 11, 2011

(86) PCT No.: PCT/AU2011/000282

§ 371 (c)(1),
(2), (4) Date: Oct. 31, 2012

(87) PCT Pub. No.: WO2011/113088

PCT Pub. Date: Sep. 22, 2011

(65) Prior Publication Data

US 2013/0061539 A1 Mar. 14, 2013

(30) Foreign Application Priority Data

Mar. 16, 2010 (AU) ..... 2010901101

(51) Int. Cl.
*E04B 1/32* (2006.01)

(52) U.S. Cl.
CPC ..... *E04B 1/3211* (2013.01)
USPC ..... 52/80.1

(58) Field of Classification Search
USPC ..... 52/80.1–81.6, 223.6, 223.7, 81.1, 52/81.2, 81.3, 81.4, 81.5, 222, 231; 135/90, 135/97, 115, 908; 244/142, 145, 153 R
See application file for complete search history.

(56) References Cited

U.S. PATENT DOCUMENTS

| | | | | | |
|---|---|---|---|---|---|
| 3,391,504 | A | * | 7/1968 | McLorg | 52/2.17 |
| 3,638,368 | A | * | 2/1972 | Pierson | 52/2.17 |
| 3,744,191 | A | * | 7/1973 | Bird | 52/2.23 |
| 4,325,207 | A | * | 4/1982 | Russell et al. | 52/641 |
| 4,442,059 | A | * | 4/1984 | Boyce | 264/228 |
| 6,134,849 | A | * | 10/2000 | Holler | 52/80.1 |

(Continued)

FOREIGN PATENT DOCUMENTS

| | | |
|---|---|---|
| DE | 2843916 | 5/1979 |
| DE | 289081 | 4/1991 |

(Continued)

OTHER PUBLICATIONS

Machine translation of FR2408700 which is corresponding document to DE2843916 (A1).

*Primary Examiner* — William Gilbert
*Assistant Examiner* — Kyle Walraed-Sullivan
(74) *Attorney, Agent, or Firm* — Cox Smith Matthews Incorporated

(57) ABSTRACT

A domed roof structure may include a plurality of generally rectangular roof members each including an upper surface; a lower surface; a pair of first opposed side surfaces and a pair of second opposed side surfaces, each diverging from the upper surface to the lower surface; a first passage from one to the other of the pair of the first side surfaces; and a second passage from one to the other of the pair of the second side surfaces. A first cable may pass through the first passages in adjacent said roof members; and a second cable may pass through the second passages in adjacent said roof members. Applying tension to the cables may drive the end faces of adjacent said roof members towards each other thereby increasing the angle between adjacent said roof members so as to form a domed roof structure.

10 Claims, 10 Drawing Sheets

(56) References Cited

U.S. PATENT DOCUMENTS

| | | | | |
|---|---|---|---|---|
| 2002/0059777 | A1* | 5/2002 | Saebi | 52/745.07 |
| 2002/0144469 | A1* | 10/2002 | Glavan | 52/81.3 |
| 2010/0095606 | A1* | 4/2010 | Bankston | 52/83 |

FOREIGN PATENT DOCUMENTS

| | | |
|---|---|---|
| GB | 1577922 | 10/1980 |
| SU | 1308725 | 5/1987 |
| WO | 2011113088 | 9/2011 |

* cited by examiner

DOMED NON-STEEL ROOF STRUCTURE

CROSS REFERENCE TO RELATED APPLICATIONS

This application is a U.S. National Stage Application claiming priority to PCT Patent Application Serial No. PCT/AU2011/000282 entitled "A DOMED NON-STEEL ROOF STRUCTURE," filed 11 Mar. 2011, which claims priority to Australian Provisional Patent Application Serial No. AU2010901101 entitled "A DOMED NON-STEEL ROOF STRUCTURE," filed 16 Mar. 2010, both of which are hereby entirely incorporated herein by reference.

TECHNICAL FIELD

The present invention relates to a domed non-steel roof structure.

The invention has been primarily developed for use in building large industrial, commercial and sporting complexes and will be described hereinafter with reference to these applications. However, the invention is not limited to these applications and is also suitable for other non-steel structural and architectural works.

BACKGROUND OF THE INVENTION

Australian Patent Application No. 2008202183 discloses embodiments of domed non-steel roof structures that are able to withstand far greater loads than conventional roof structures of similar size and produced from similar materials. The disclosed structures can be designed to meet strength and dynamic requirements, whilst reducing the need to increase the material added to the structure to satisfy deflection requirements. The disclosed structures are also lighter and cheaper than existing comparable structures, particularly when foundation savings are taken into account and are also readily adaptable for use in demountable applications.

OBJECT OF THE INVENTION

It is the object of the present invention to improve the assembly of domed non-steel roof structures similar to, but not limited to, those disclosed in Australian Patent Application No. 2008202183.

SUMMARY OF THE INVENTION

Accordingly, in a first aspect, the present invention provides a domed non-steel roof structure, the roof structure including:

a plurality of non-steel, generally rectangular roof members, each of the roof members including:

an upper surface;

a lower surface;

a pair of first opposed side surfaces diverging from the upper surface to the lower surface;

a pair of second opposed side surfaces diverging from the upper surface to the lower surface;

at least one first passage from one of the pair of the first side surfaces to the other of the pair of the first side surfaces; and at least one second passage from one of the pair of the second side surfaces to the other of the pair of the second side surfaces;

a first cable passing through the first passages in adjacent said roof members; and a second cable passing through the second passages in adjacent said roof members, whereby applying tension to the first cable adjacent the outermost two of the first side surfaces and applying tension to the second cable adjacent the outermost two of the second side surfaces drives the end faces of adjacent said roof members towards each other thereby increasing the angle between adjacent said roof members in a first direction and a second direction, substantially normal to the first direction.

The roof members preferably include a pair of first passages and a pair of second passages. Each of the first passages are preferably disposed substantially adjacent each of the second side surfaces and each of the second passages are preferably disposed substantially adjacent each of the first side surfaces. Each of the roof members are preferably curved along the first direction and curved along the second direction.

The outer surface of each of the roof members are preferably in the shape of a portion of a dome or sphere.

The first passages preferably include a plurality of first cables passing therethrough and the second passages preferably include a plurality of second cables passing therethrough.

Each of the roof members in the domed roof structure are preferably substantially identical.

The exterior sides of the domed non-steel roof structure preferably include reinforcing truss or beam arrangements.

The roof structure preferably includes one or more first hinges between the first side surfaces of adjacent roof members and one or more second hinges between the second side surfaces of adjacent roof members.

The non-steel roof members are formed from, or include, any one of: aluminium and other alloys; carbon fibre; plastics; ceramics; timber; or glass.

BRIEF DESCRIPTION OF THE DRAWINGS

Preferred embodiments of the invention will now be described, by way of examples only, with reference to the accompanying drawings in which.

DETAILED DESCRIPTION OF THE PREFERRED EMBODIMENTS

Figure 1:
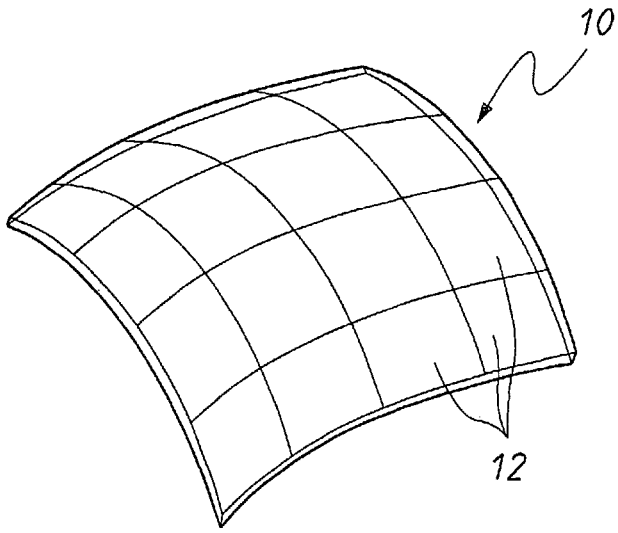
FIG. 1 shows a first embodiment of a domed non-steel roof structure.

FIG. 1 shows a first embodiment of a domed non-steel roof structure 10. The structure 10 is comprised of sixteen non-steel, generally rectangular (or square) roof members 12 arranged in a four by four matrix. The structure 10 can be of any dimension, subject to material considerations. As an example only, the structure 10 is between about 5-25 m long and wide. The non-steel roof members 12 can be formed from, or include, any one of: aluminium and other alloys; carbon fibre; plastics; ceramics; timber; or glass.

Figure 2:
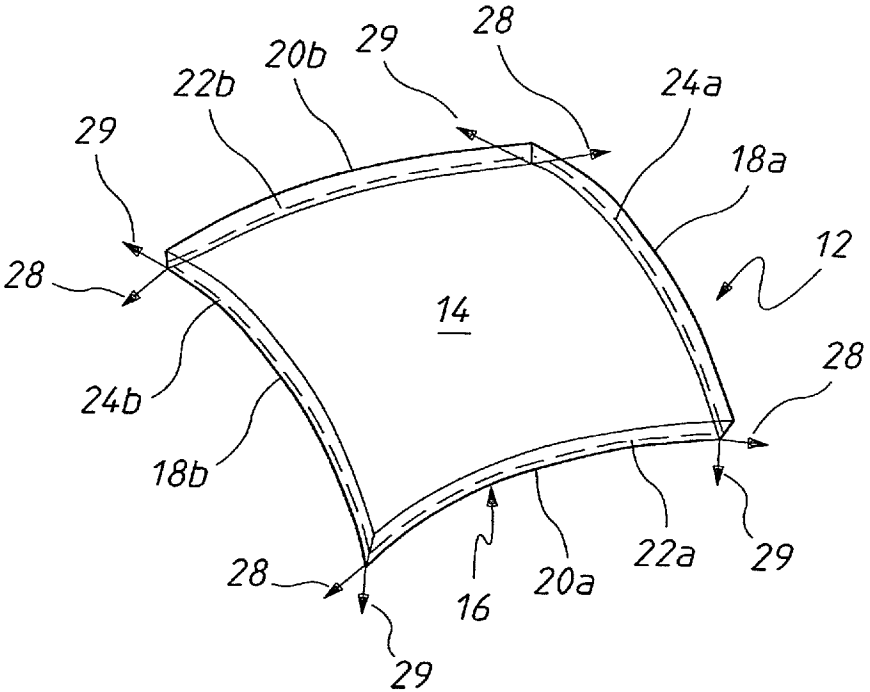
FIG. 2 is a schematic perspective view of a roof member used in the embodiment of the domed non-steel roof structure shown in FIG. 1.

FIG. 2 shows one of the roof members 12 in isolation. The roof members 12 are all in the shape of a portion or segment of a dome or sphere. The roof member 12 includes an upper surface 14 and a lower surface 16. A pair of opposed first side surfaces 18*a* and 18*b* are angled with respect to each other to diverge from the upper surface 14 to the lower surface 16. A pair of opposed second side surfaces 20*a* and 20*b* similarly diverge from the upper surface 14 to the lower surface 16. As the roof member 12 is rectangular when viewed from above, the pair of first side surfaces 18*a* and 18*b* are orientated substantially normally to the pair of second side surfaces 20*a*, 20*b*.

The roof member 12 also includes a pair of first passages 22*a* and 22*b* which extend through the roof member 12 from the first side surface 18*a* to the opposed first side surface 18*b*. The roof member 12 also includes a similar pair of second passages 24*a* and 24*b* which extend from the second side surface 20*a* to the opposed second side surface 20*b*. The first passages 22*a*, 22*b* are positioned near the second side surfaces 20*a*, 20*b* and the second passages 24*a*, 24*b* are positioned near the first side surfaces 18*a*, 18*b*.

Figure 3:
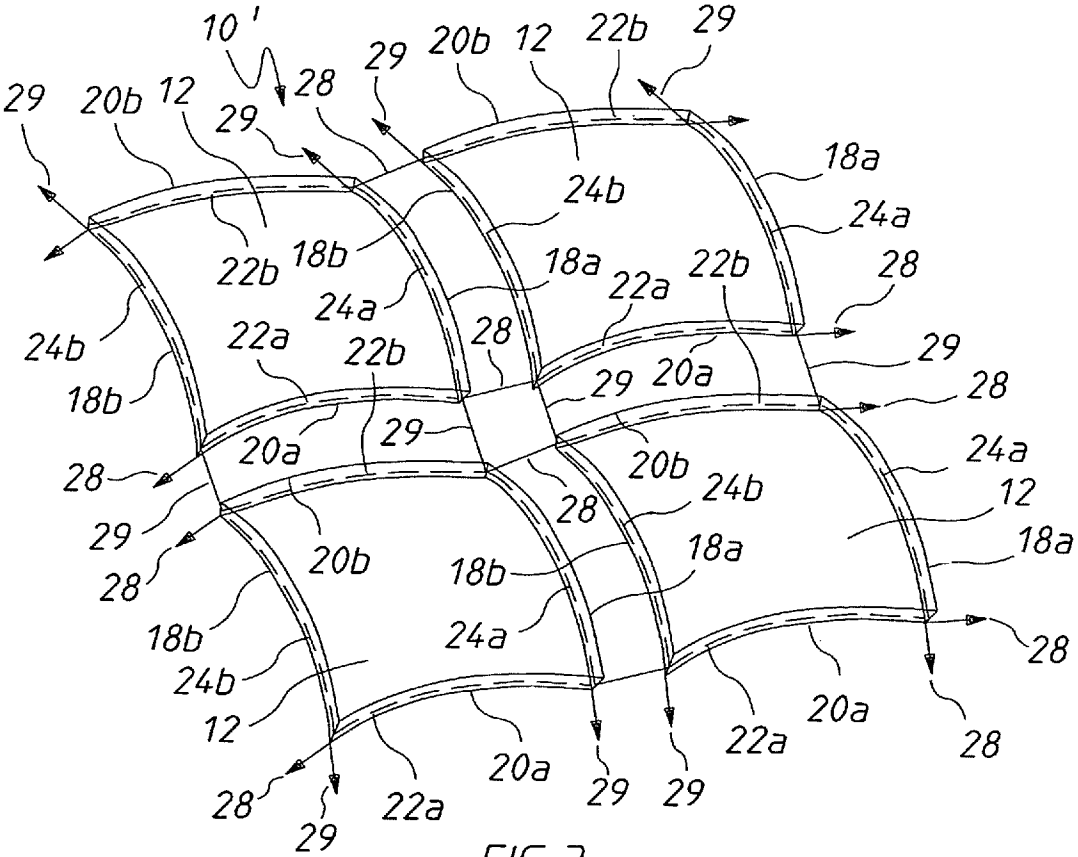
FIG. 3 is a schematic perspective view of the initial assembly of a second embodiment of a domed non-steel roof structure using four of the roof members shown in FIG. 2.
Figure 4:
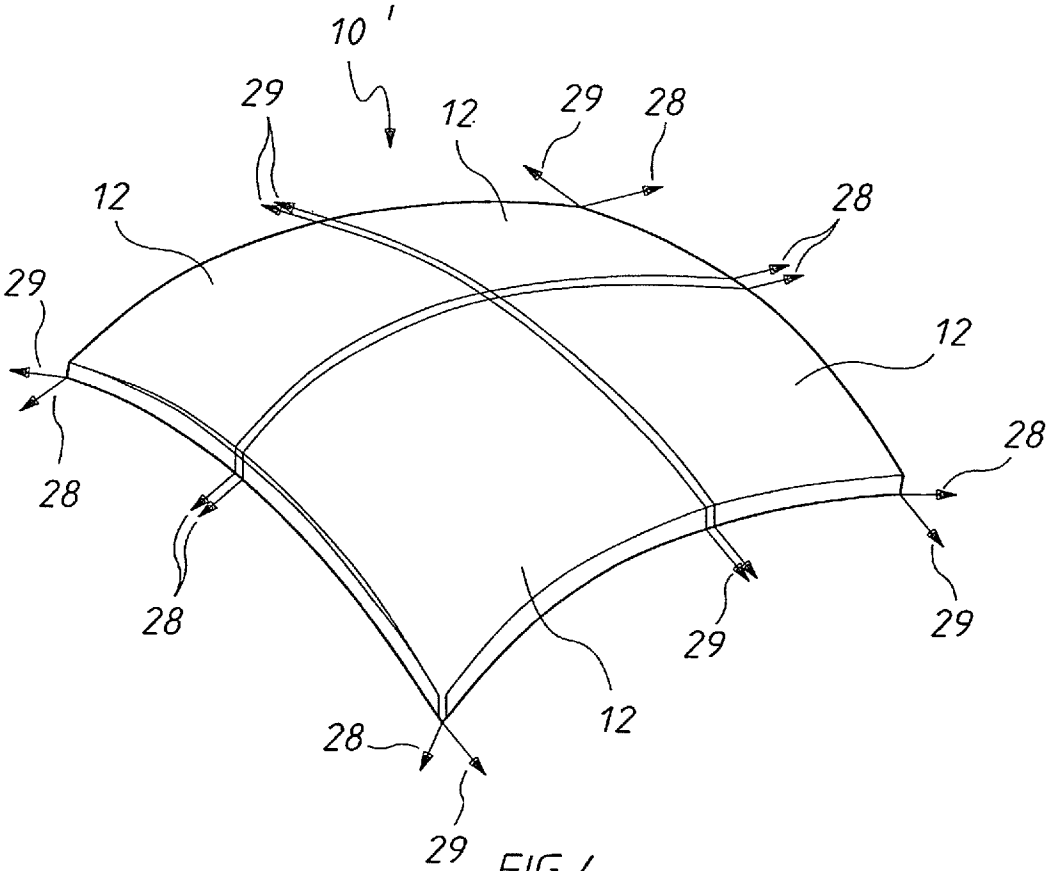
FIG. 4 is a schematic perspective view of the final assembly of the second embodiment of domed non-steel roof structure using four of the roof members shown in FIG. 2.

The assembly of an embodiment of a domed non-steel roof structure 10' from four of the roof members 12 will now be described with reference to FIGS. 3 and 4. FIG. 3 shows four of the roof members 12 initially positioned adjacent one another upon ground level. Four of the first cables 28 are respectively passed through adjacent first passages 22*a* in each of the roof members 12. Four of the second cables 29 are similarly passed through respective adjacent second passages 24*a* and 24*b*.

The roof members 12 are then positioned with the edges between their top surfaces 14 and adjacent first sides 18*a* and 18*b* in contact. An angled gap is thus formed between the adjacent first side surfaces 18*a* and 18*b*. A force is then applied to the ends of the first cables 28, relative to the roof members 12, adjacent the outermost two of the sides 18*a* and 18*b*, for example by jacking. The force drives the roof members 12 together in a manner which increases the overall angle between them and reduces the angled gap. A similar force is also applied to the ends of the second cables 29. The forces drive the roof members 12 together in a manner which increases the overall angle between them and reduces the angled gaps. This movement causes the roof members 12 to rise towards the domed configuration shown in FIG. 4.

For a permanent structure 10', the cables 28 and 29 are then bonded to the roof members 12, for example by applying grout into the passages 22*a* and 22*b*. For a temporary structure 10', the external ends of the cables 28 and 29 are releasably fixed relative to the external sides 18*a* and 18*b* of the roof structure 10', for example by clamping, and are left unbonded.

The domed roof structure 10 can advantageously be quickly, easily and relatively inexpensively built, as extensive scaffolding and false work is not required to facilitate construction. The structure 10 can be produced in a range of sizes to suit small and large span buildings. The structure 10 can be created permanent or demountable form.

In addition, the domed roof structure 10 also possesses the load resisting advantages of the domed non-steel roof frames disclosed in Australian Patent Application No. 2008202183.

Figure 5:
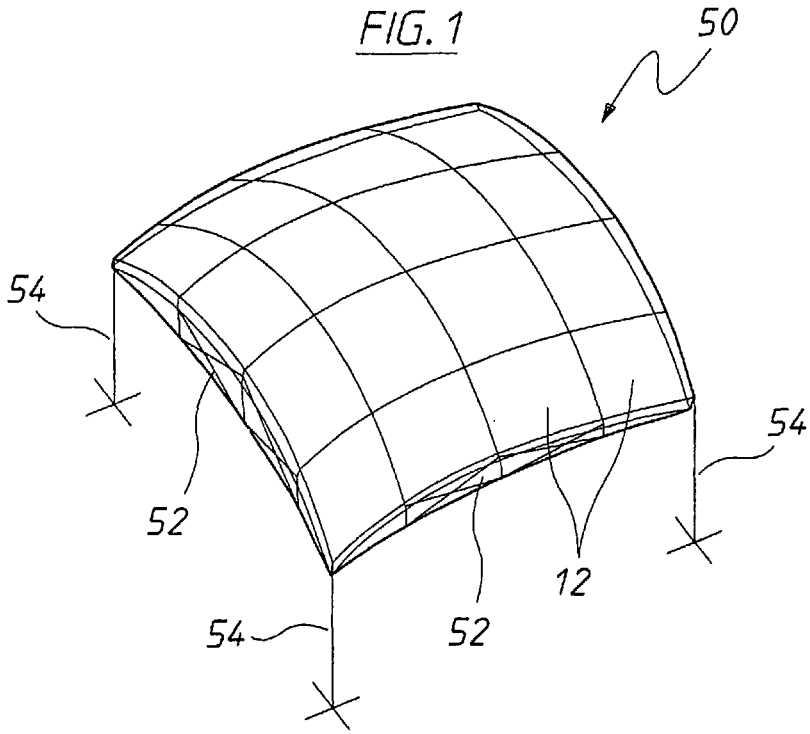
FIG. 5 is a third embodiment of a domed non-steel roof structure.

FIG. 5 shows a second embodiment of a domed non-steel roof structure 50. The structure 50 is similar to the structure 10 and like features have been indicated with like reference numerals to those used to describe the structure 10. However, in addition, the exterior sides and edges of the structure 50 are reinforced by truss and beam arrangements 52 and the structure 50 is elevated by columns 54.

Figure 6:
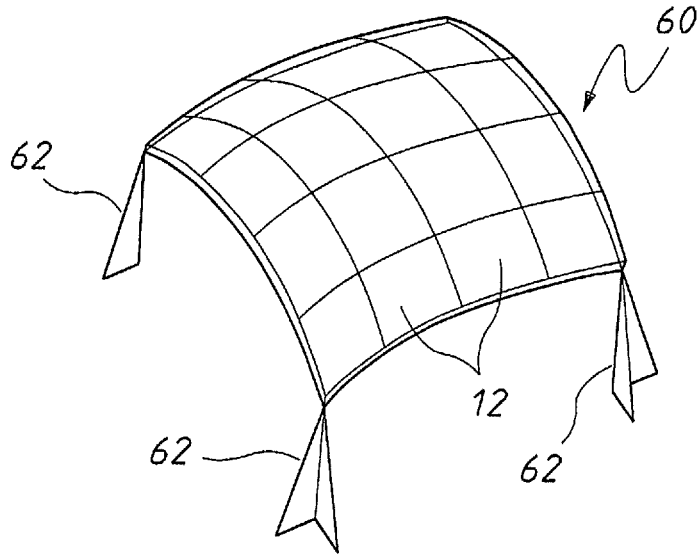
FIG. 6 is a fourth embodiment of a domed non-steel roof structure.

FIG. 6 shows a fourth embodiment of a domed non-steel roof structure 60, which is also similar to the roof structure 10 shown in FIG. 1, aside from the addition of reinforced supporting columns 62 at each corner.

Figure 7:
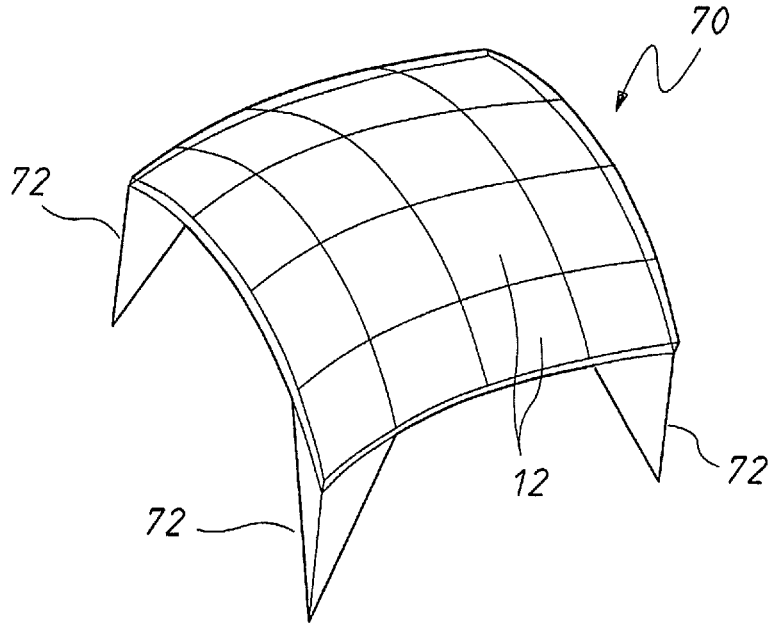
FIG. 7 is a fifth embodiment of a domed non-steel roof structure.

FIG. 7 shows a fifth embodiment of a domed non-steel roof structure 70, which is similar to the roof structure 60 shown in FIG. 6, aside from inverted supporting columns 72 at each corner.

Figure 8:
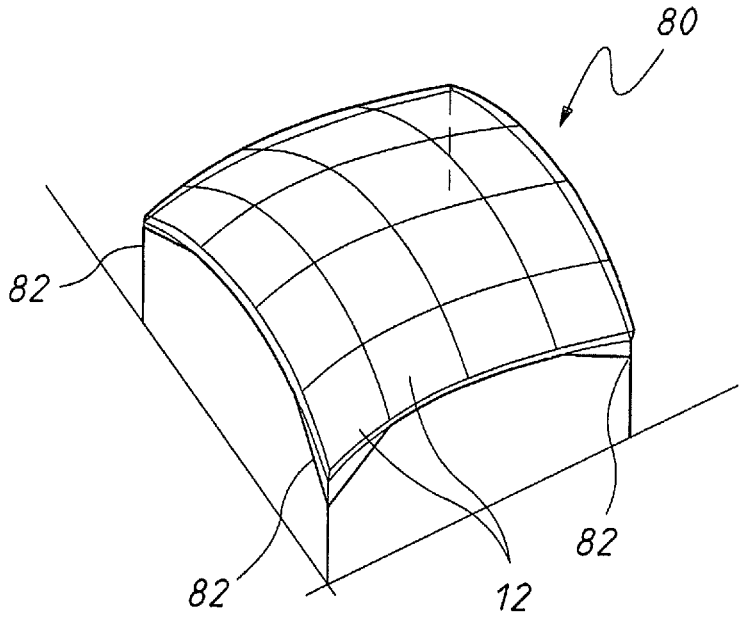
FIG. 8 is a sixth embodiment of a domed non-steel roof structure.
Figure 9C:
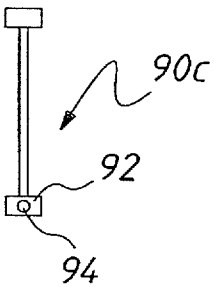
FIGS. 9*a* to 9*d* are embodiments of external beam configurations of roof members.
Figure 9B:
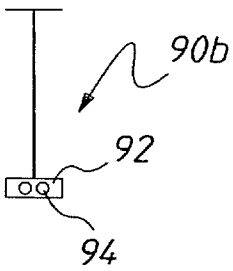
Figure 9A:
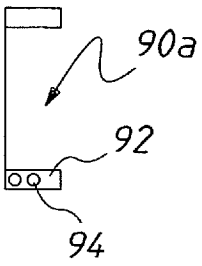
Figure 9D:
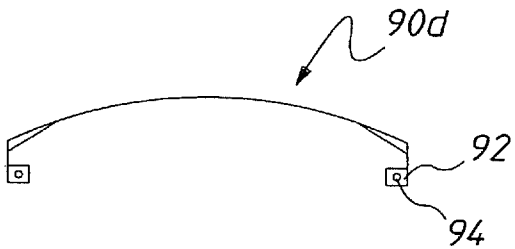

FIG. 8 shows a sixth embodiment of a domed non-steel roof structure 80, which again is similar to the roof structures 60 and 70 shown in FIGS. 6 and 7, aside from the form of supporting columns 82 at each corner.

FIGS. 9*a* to 9*d* show cross-sectional views of beam and/or truss members 90*a*, 90*b*, 90*c* and 90*d* used to form the periphery of alternative roof members 12. The beam/truss members 90*a*, 90*b*, 90*c* and 90*d* are initially produced in straight lengths then rolled to produce segments that are arcuate in nature and thus suitable to form the exterior/sides of the roof members 12. Each of the beam/truss members 90*a*, 90*b*, 90*c* and 90*d* also incorporate a passage 92 and is shown with one or more cables 94 therein.

Figure 10:
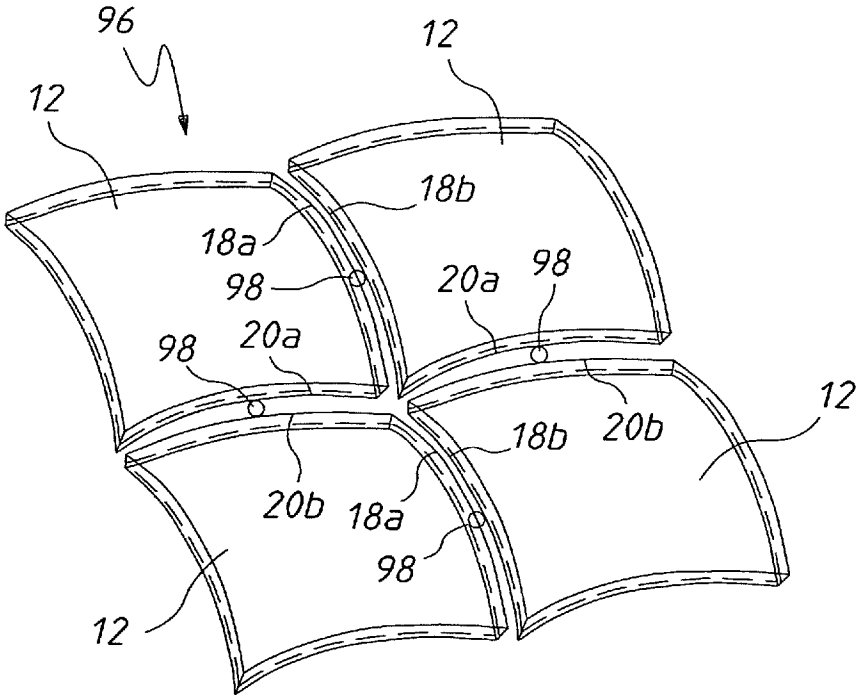
FIG. 10 is a schematic perspective view of the intermediate assembly of a seventh embodiment of a domed non-steel roof structure.

The assembly of a seventh embodiment of domed non-steel roof structure 96 from 4 of the roof members 12 will now be described with reference to FIG. 10. The roof structure 96 is similar to that described with reference to FIGS. 3 and 4, except for the addition of hinges 98 between the adjacent roof members 12. The hinges 98 assist in keeping the roof members 12 positioned with the edge between their top surfaces 14 and adjacent first sides 18*a* and 18*b* and adjacent second sides 20*a* and 20*b* in contact during their rise towards the completed domed configuration.

Figure 11:
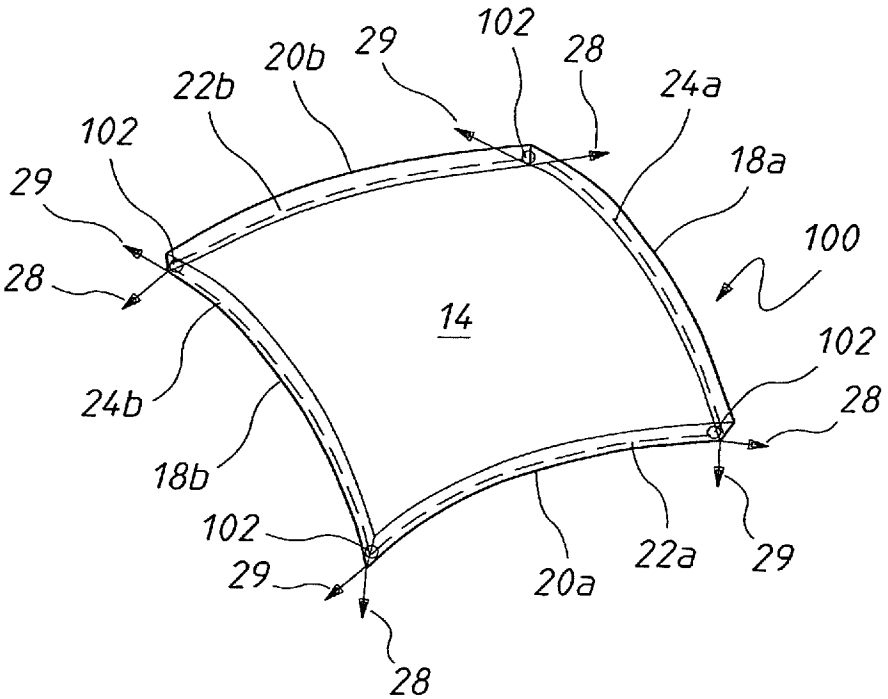
FIG. 11 is a schematic perspective view of a roof member used in an eighth embodiment of a domed non-steel roof structure.

FIG. 11 shows a roof member 100 of an eighth embodiment of domed non-steel roof structure in isolation. The roof member 100 is similar to the roof member 12 shown in FIG. 2, expect for the addition of hinges 102, similar to those described with reference to FIG. 10, at each corner of the roof member 100.

Figure 12:
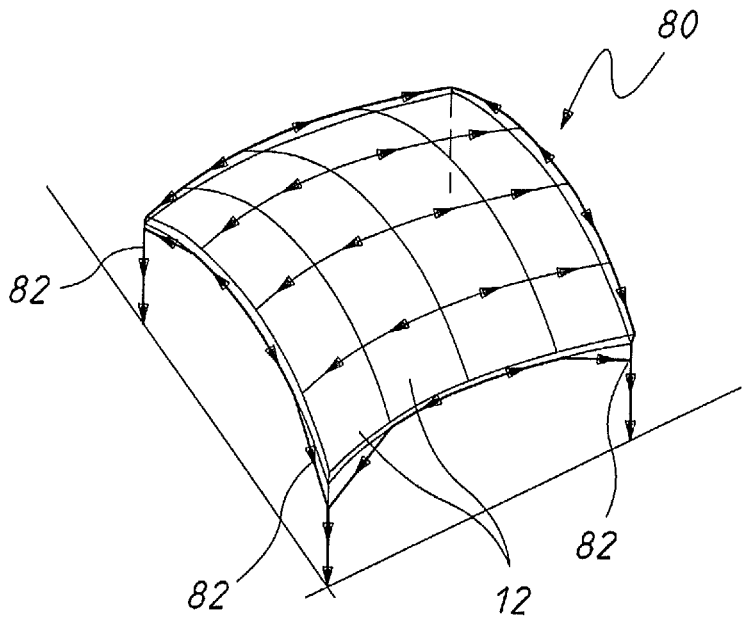
FIG. 12 is a schematic perspective view of the eighth embodiment of domed non-steel roof structure shown in FIG. 11, with tensile lines of resistance shown for resisting upward loads.

FIG. 12 shows the roof structure 80 of FIG. 8 with the addition of arrows showing the tensile lines of resistance in the roof structure 80 when it is subjected to its intended (upward) load during use. The tension in the cables advantageously also resists deflection in the structure 80 caused by that load. The structure 80 is able to resist deflection under its designed load conditions as the tension applied to the cables (to assemble the structure 80) relative to the roof members also stores strain energy in the structure 80. Accordingly, as load is applied to the structure 80, the counter strain stored in the structure 80 resists the application of that load, thereby advantageously increasing the load capacity of the structure 80 for a given deflection.

Although the invention has been described with reference to preferred embodiments, it will be appreciated by persons skilled in the art that the invention can be embodied in many other forms.

The invention claimed is:

1. A domed non-steel roof structure, the roof structure including:

a plurality of non-steel, generally rectangular roof members, each of the roof members including:

an upper surface;

a lower surface;

a pair of first opposed side surfaces diverging from the upper surface to the lower surface;

a pair of second opposed side surfaces diverging from the upper surface to the lower surface;

at least one first passage from one of the pair of the first side surfaces to the other of the pair of the first side surfaces; and at least one second passage from one of the pair of the second side surfaces to the other of the pair of the second side surfaces;

a first cable passing through the first passages in adjacent said roof members; and a second cable passing through the second passages in adjacent said roof members, whereby applying tension to the first cable adjacent the outermost two of the first side surfaces and applying tension to the second cable adjacent the outermost two of the second side surfaces drives the end faces of adjacent said roof members towards each other thereby increasing the angle between adjacent said roof members in a first direction and a second direction, substantially normal to the first direction.

2. The roof structure as claimed in claim 1, wherein the roof members include a pair of first passages and a pair of second passages.

3. The roof structure as claimed in claim 2, wherein each of the first passages are disposed substantially adjacent each of the second side surfaces and each of the second passages are disposed substantially adjacent each of the first side surfaces.

4. The roof structure as claimed in claim 1, wherein each of the roof members are curved along the first direction and curved along the second direction.

5. The roof structure as claimed in claim 1, wherein the upper surface of each of the roof members are in the shape of a portion of a dome or sphere.

6. The roof structure as claimed in claim 1, wherein the first passages include a plurality of first cables passing therethrough and the second passages include a plurality of second cables passing therethrough.

7. The roof structure as claimed in claim 1, wherein each of the roof members in the domed roof structure are substantially identical.

8. The roof structure as claimed in claim 1, wherein the exterior sides of the domed non-steel roof structure include reinforcing truss or beam arrangements.

9. The roof structure as claimed in claim 1, wherein the roof structure includes one or more first hinges between the first side surfaces of adjacent roof members and one or more hinges between the second side surface of adjacent roof members.

10. The roof structure as claimed in claim 1, wherein the non-steel roof members are formed from, or include, any one of: aluminum and other alloys; carbon fiber; plastics; ceramics; timber; or glass.

* * * * *